US011423834B2

(12) United States Patent
Park et al.

(10) Patent No.: US 11,423,834 B2
(45) Date of Patent: Aug. 23, 2022

(54) DISPLAY DEVICE AND METHOD OF DRIVING THE SAME

(71) Applicant: Samsung Display Co., Ltd., Yongin-Si (KR)

(72) Inventors: Se Hyuk Park, Yongin-si (KR); Hong Soo Kim, Yongin-si (KR); Jin Young Roh, Yongin-si (KR); Hyo Jin Lee, Yongin-si (KR); Jae Keun Lim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/142,131

(22) Filed: Jan. 5, 2021

(65) Prior Publication Data

US 2021/0407436 A1 Dec. 30, 2021

(30) Foreign Application Priority Data

Jun. 26, 2020 (KR) ..... 10-2020-0078690

(51) Int. Cl.

| | |
|---|---|
| ***G09G 3/3291*** | (2016.01) |
| ***G09G 3/3266*** | (2016.01) |
| ***G09G 3/20*** | (2006.01) |
| ***G09G 3/3233*** | (2016.01) |

(52) U.S. Cl.

CPC ..... *G09G 3/3233* (2013.01); *G09G 3/2096* (2013.01); *G09G 2300/0819* (2013.01); *G09G 2300/0842* (2013.01); *G09G 2300/0861* (2013.01); *G09G 2320/045* (2013.01); *G09G 2340/0435* (2013.01); *G09G 2360/16* (2013.01)

(58) Field of Classification Search

CPC .... G09G 3/32–3291; G09G 2300/0809–0871; G09G 2320/045; G09G 2310/08; G09G 2340/0435

See application file for complete search history.

(56) References Cited

U.S. PATENT DOCUMENTS

| | | | | |
|---|---|---|---|---|
| 9,570,010 | B2 * | 2/2017 | Yang | G09G 3/3258 |
| 10,325,557 | B2 * | 6/2019 | Cho | G09G 3/3233 |
| 10,380,940 | B2 * | 8/2019 | Lee | G09G 3/3275 |
| 10,460,639 | B2 * | 10/2019 | Gu | G09G 3/3225 |
| 10,510,284 | B2 * | 12/2019 | Hayashi | G09G 3/3648 |
| 10,565,953 | B2 * | 2/2020 | Kim | G09G 3/3648 |
| 10,586,496 | B2 * | 3/2020 | Kim | G09G 3/3233 |
| 10,700,146 | B2 * | 6/2020 | Chai | H01L 27/3276 |
| 10,902,817 | B2 * | 1/2021 | Koo | G09G 3/3655 |
| 11,017,723 | B2 * | 5/2021 | Lee | G09G 3/3258 |
| 11,043,184 | B2 * | 6/2021 | An | G09G 5/003 |
| 11,056,049 | B2 * | 7/2021 | Kim | G09G 3/3233 |

(Continued)

FOREIGN PATENT DOCUMENTS

| | | | |
|---|---|---|---|
| KR | 10-2018-0067768 | A | 6/2018 |
| KR | 10-2019-0081723 | A | 7/2019 |
| KR | 10-2070660 | B1 | 1/2020 |

*Primary Examiner* — Patrick F Marinelli
(74) *Attorney, Agent, or Firm* — Innovation Counsel LLP

(57) ABSTRACT

A display device includes: a pixel configured to display an image based on image data and a reference voltage; a controller configured to generate reference voltage data corresponding to the reference voltage for restraining leakage current in the pixel based on a frame frequency; and a power supply configured to generate the reference voltage based on the reference voltage data and supply the reference voltage to the pixel.

19 Claims, 11 Drawing Sheets

LUT1

| 30Hz | | |
|---|---|---|
| GRAYSCALE | Vref value | Vref |
| 0 | 3 | 4.5V |
| 1 | 3 | 4.5V |
| 2 | 4 | 4.0V |
| ⋮ | ⋮ | ⋮ |
| 253 | 5 | 3.0V |
| 254 | 6 | 2.5V |
| 255 | 6 | 2.5V |

LUT2

| 20Hz | | |
|---|---|---|
| GRAYSCALE | Vref value | Vref |
| 0 | 2 | 5.0V |
| 1 | 2 | 5.0V |
| 2 | 3 | 4.5V |
| ⋮ | ⋮ | ⋮ |
| 253 | 6 | 2.5V |
| 254 | 7 | 2.0V |
| 255 | 7 | 2.0V |

LUT3

| 10Hz | | |
|---|---|---|
| GRAYSCALE | Vref value | Vref |
| 0 | 1 | 5.5V |
| 1 | 1 | 5.0V |
| 2 | 2 | 5.0V |
| ⋮ | ⋮ | ⋮ |
| 253 | 7 | 2.0V |
| 254 | 8 | 1.5V |
| 255 | 8 | 1.5V |

(56) References Cited

U.S. PATENT DOCUMENTS

2011/0157144 A1* 6/2011 Park ..... G09G 3/3233 345/212
2012/0019501 A1* 1/2012 Choi ..... G09G 3/3233 345/211
2013/0278572 A1 10/2013 Lee et al.
2015/0001504 A1* 1/2015 Kim ..... H01L 27/32 257/40
2016/0124491 A1 5/2016 An et al.
2016/0260380 A1* 9/2016 Yang ..... G09G 3/32
2017/0004766 A1 1/2017 Cho et al.
2017/0018219 A1* 1/2017 Wang ..... G09G 3/2092
2017/0039935 A1* 2/2017 Yang ..... G09G 3/3233
2017/0116922 A1* 4/2017 Jung ..... G09G 3/3258
2017/0132964 A1* 5/2017 Lee ..... G09G 5/18
2017/0148379 A1* 5/2017 Cho ..... G09G 3/3233
2017/0294162 A1* 10/2017 Hu ..... G09G 3/3266
2018/0075796 A1* 3/2018 Hayashi ..... G09G 3/2018
2018/0122327 A1* 5/2018 Kim ..... G09G 3/3648
2018/0293944 A1* 10/2018 Kim ..... G09G 3/3275
2018/0350313 A1* 12/2018 Nambi ..... G09G 3/3611
2019/0066555 A1* 2/2019 Gu ..... G09G 3/3225
2019/0244576 A1* 8/2019 Kwak ..... G09G 3/3655
2019/0371250 A1* 12/2019 Baek ..... G09G 3/3233
2020/0082781 A1* 3/2020 An ..... G09G 3/20
2020/0372853 A1* 11/2020 Park ..... G09G 3/3233
2020/0388228 A1* 12/2020 Oh ..... G09G 5/373
2020/0394961 A1* 12/2020 Kim ..... G09G 3/3233
2021/0005130 A1* 1/2021 Roh ..... G09G 5/006
2021/0020113 A1* 1/2021 Park ..... G09G 3/3225
2021/0027686 A1* 1/2021 Roh ..... G09G 3/20
2021/0027696 A1* 1/2021 Kim ..... G09G 3/32
2021/0074217 A1* 3/2021 Lee ..... G09G 3/3266
2021/0110771 A1* 4/2021 Lee ..... G09G 3/3258
2021/0193024 A1* 6/2021 Jang ..... G09G 3/3233
2021/0225266 A1* 7/2021 Hyun ..... G09G 3/32

* cited by examiner

FIG. 6

LUT1

| 30Hz | | |
|---|---|---|
| GRAYSCALE | Vref value | Vref |
| 0 | 3 | 4.5V |
| 1 | 3 | 4.5V |
| 2 | 4 | 4.0V |
| ⋮ | ⋮ | ⋮ |
| 253 | 5 | 3.0V |
| 254 | 6 | 2.5V |
| 255 | 6 | 2.5V |

LUT2

| 20Hz | | |
|---|---|---|
| GRAYSCALE | Vref value | Vref |
| 0 | 2 | 5.0V |
| 1 | 2 | 5.0V |
| 2 | 3 | 4.5V |
| ⋮ | ⋮ | ⋮ |
| 253 | 6 | 2.5V |
| 254 | 7 | 2.0V |
| 255 | 7 | 2.0V |

LUT3

| 10Hz | | |
|---|---|---|
| GRAYSCALE | Vref value | Vref |
| 0 | 1 | 5.5V |
| 1 | 1 | 5.0V |
| 2 | 2 | 5.0V |
| ⋮ | ⋮ | ⋮ |
| 253 | 7 | 2.0V |
| 254 | 8 | 1.5V |
| 255 | 8 | 1.5V |

DISPLAY DEVICE AND METHOD OF DRIVING THE SAME

CROSS-REFERENCE TO RELATED APPLICATION

The present application claims priority to Korean patent application number 10-2020-0078690 filed on Jun. 26, 2020, the disclosure of which is incorporated herein by reference in its entirety.

BACKGROUND

Field of Invention

Various embodiments of the present disclosure relate to a display device, and more particularly, to a display device capable of varying a driving frequency and a method of driving the display device.

Description of Related Art

A display device displays an image using control signals applied from an external device.

The display device may include a plurality of pixels. Each of the pixels may include a plurality of transistors, a light emitting element electrically coupled to the transistors, and a capacitor. The transistors may generate driving current based on signals provided through signal lines. The light emitting element may emit light according to the driving current.

To enhance the driving efficiency of the display device, the power consumption of the display device may be reduced in various manners. For example, the power consumption of the display device may be reduced by decreasing a driving frequency (or a data writing frequency) for displaying a static image. However, in a case where the display device displays an image in a low driving frequency, leakage of driving current may occur in a pixel, and flickering or the like of the displayed image may be discerned.

SUMMARY

Various embodiments of the present disclosure are directed to a display device in which the value of a reference voltage to be supplied to a pixel is adjusted based on variation in driving frequency and a representative grayscale of a frame.

Various embodiments of the present disclosure are directed to a method of driving a display device in which the value of a reference voltage to be supplied to a pixel is adjusted depending on variation in driving frequency and a representative grayscale of a frame.

However, the present disclosure is not limited to the above-described embodiments, and various modifications are possible without departing from the spirit and scope of the present disclosure.

According to an embodiment of the present disclosure, a display device includes: a pixel configured to display an image based on image data and a reference voltage; a controller configured to generate reference voltage data corresponding to the reference voltage for restraining leakage current in the pixel based on a frame frequency; and a power supply configured to generate the reference voltage based on the reference voltage data and supply the reference voltage to the pixel.

In an embodiment, the controller may determine the reference voltage data with further reference to a representative value of a grayscale of the image data.

In an embodiment, the representative value may be an average of grayscales included in the image data of a frame.

In an embodiment, for the representative value being the same, the reference voltage may change as the frame frequency changes from a first frequency to a second frequency.

In an embodiment, for the frame frequency being the same, the reference voltage may change as the representative value changes from a first value to a second value.

In an embodiment, the controller may include: a frequency analyzer configured to determine the frame frequency based on at least one of a vertical synchronization signal and a data enable signal supplied from an external device; a representative value determiner configured to determine the representative value based on grayscales included in the image data; and a voltage data generator configured to generate the reference voltage data with reference to a lookup table that stores values of the reference voltage corresponding to the frame frequency and the grayscale.

In an embodiment, the voltage data generator may include: a comparator configured to compare the frame frequency and a reference frequency; and a data determiner configured to determine the reference voltage data based on a result of comparison of the comparator.

In an embodiment, for the frame frequency being equal to or greater than the reference frequency, the data determiner may output a default value of the reference voltage data corresponding to a default value among the values of the reference voltage. For the frame frequency being less than the reference frequency, the data determiner may determine the reference voltage data with reference to the lookup table.

In an embodiment, the data determiner may extract a plurality of reference values from the lookup table based on the frame frequency and the representative value, and calculate the reference voltage data by interpolating the reference values.

In an embodiment, the controller may further include a register configured to output a compensation factor in which a distribution of threshold voltages of a driving transistor of the pixel is reflected. The power supply may output the reference voltage based on the reference voltage data and the compensation factor.

In an embodiment, the power supply may include a variable resistor circuit configured to adjust a resistance value based on the reference voltage data, and change an input power voltage based on the resistance value.

In an embodiment, the display device may further include: a data driver configured to supply a data voltage to the pixel through a data line based on the image data; a scan driver configured to supply a first scan signal to the pixel through a first scan line, supply a second scan signal to a second scan line; and an emission driver configured to supply a first emission control signal to the pixel through a first emission control line. The pixel may include: a light emitting element; a first transistor configured to control driving current based on a voltage of a first node and being coupled between a second node and a third node; a second transistor coupled between the data line and the second node, and configured to be turned on by the first scan signal supplied to the first scan line; a third transistor and a fourth transistor coupled in series between the first node and the third node and configured to be turned on by the second scan signal supplied to the second scan line; a fifth transistor configured to supply the reference voltage to a fourth node between the third transistor and the fourth transistor and to be turned off by the first emission control signal supplied to the first emission control line; and a sixth transistor coupled between a first power supply voltage and the second node and configured to be turned off by the first emission control signal.

In an embodiment, the scan driver may be further configured to supply a third scan signal to the pixel through a third scan line and supply a fourth scan signal to the pixel through a fourth scan line, and wherein the pixel may further include: a seventh transistor coupled between the third node and the light emitting element, and configured to be turned off by the first emission control signal; an eighth transistor configured to supply an initialization voltage to the light emitting element and to be turned on by the third scan signal supplied to the third scan line; a ninth transistor and a tenth transistor coupled in series between the first node and a power line for supplying the initialization voltage, and configured to be turned on by the fourth scan signal supplied to the fourth scan line; and an eleventh transistor configured to supply the reference voltage to a fifth node between the ninth transistor and the tenth transistor, and to be turned off by the first emission control signal.

In an embodiment, an identical scan signal may be supplied to the first scan line and the second scan line.

In an embodiment, the scan driver may be further configured to supply a third scan signal to the pixel through a third scan line, the emission driver may be further configured to supply a second emission control signal to the pixel through a second emission control line, and the pixel may further include: a seventh transistor coupled between the third node and the light emitting element, and configured to be turned off by the second emission control signal supplied to the second emission control line; and an eighth transistor configured to supply an initialization voltage to the third node and to be turned on by the third scan signal supplied to the third scan line.

In an embodiment, the second emission control signal may be supplied later than the first emission control signal.

In an embodiment, a first frequency at which the first scan signal is supplied to the first scan line may be equal to the frame frequency. A second frequency at which the first emission control signal is supplied to the first emission control line may be greater than the frame frequency.

According to an embodiment of the present disclosure, a method of driving a display device includes: determining a frame frequency based on at least one of a data enable signal and a vertical synchronization signal; determining, based on grayscales included in image data of a frame, a representative value of a grayscale of the frame; generating reference voltage data corresponding to a reference voltage based on the frame frequency and the representative value; and supplying, to a pixel, the reference voltage for restraining leakage current in the pixel based on the reference voltage.

In an embodiment, for the representative value of the image data being the same, the reference voltage may change as the frame frequency changes from a first frequency to a second frequency.

In an embodiment, generating the reference voltage data may include: comparing the frame frequency and a reference frequency; outputting a default value of the reference voltage data regardless of the frame frequency and the representative value for the frame frequency being equal to or greater than the reference frequency; and calculating the reference voltage data corresponding to the frame frequency and the representative value with reference to a lookup table for the frame frequency being less than the reference frequency.

Since the value of a reference voltage may be controlled based on the frame frequency and the representative value of a grayscale of a corresponding frame, the display device may minimize leakage current in the pixel and mitigate image flicker by controlling the reference voltage in response to variation in the frame frequency.

Furthermore, since leakage current may be minimized depending on the frame frequency, the display device may display a static image at a very low frequency. Hence, the display device may implement a reliable low-power driving operation while reducing the power consumption.

However, the present disclosure is not limited to the above-described embodiments, and various modifications are possible without departing from the spirit and scope of the present disclosure.

BRIEF DESCRIPTION OF THE DRAWINGS

FIG. 6 is a diagram illustrating an example of a lookup table included in the controller of FIG. 4.

DETAILED DESCRIPTION

Figure 1:
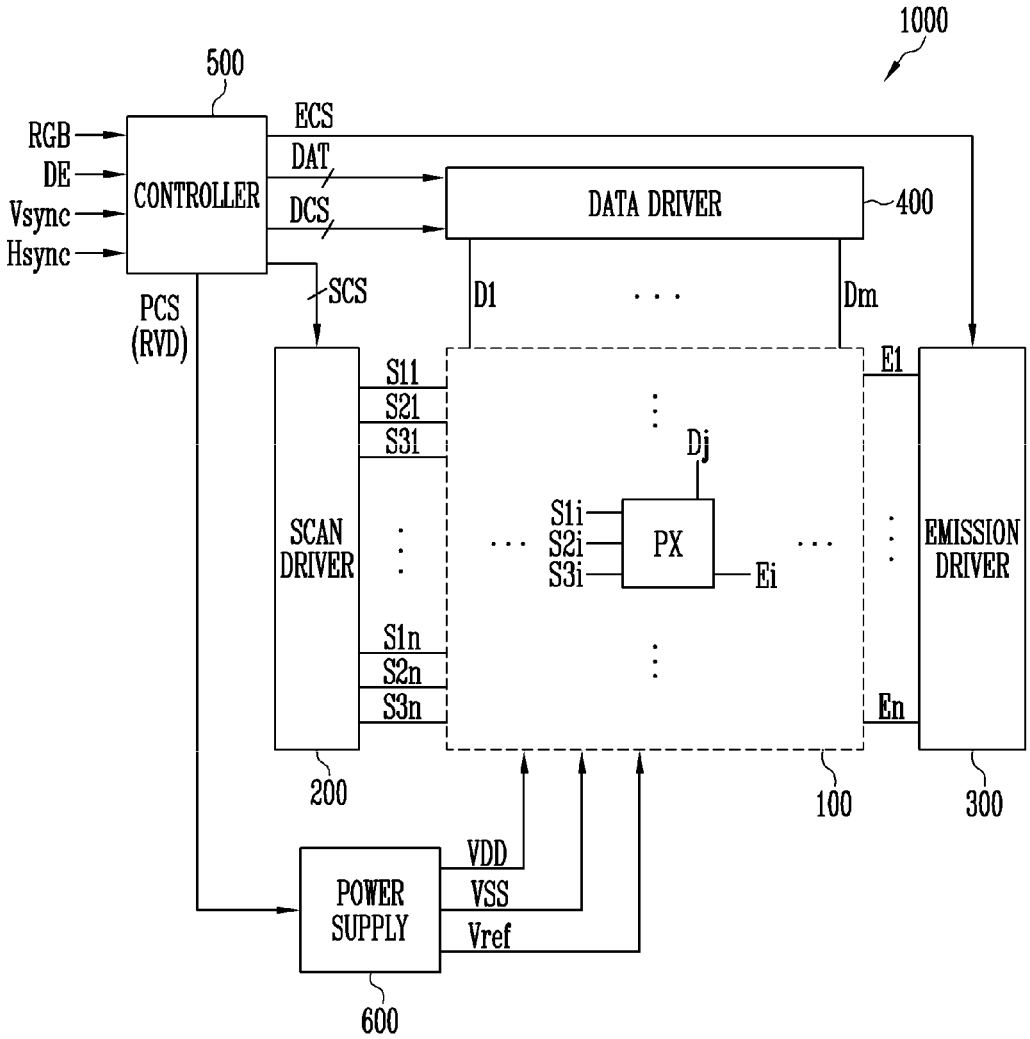
FIG. 1 is a block diagram illustrating a display device in accordance with an embodiment of the present disclosure.

Various embodiments of the present disclosure will hereinafter be described in detail with reference to the accompanying drawings. The same reference numerals are used throughout the drawings to designate the same components, and repetitive description of the same components will be omitted.

FIG. 1 is a block diagram illustrating a display device 1000 in accordance with an embodiment of the present disclosure.

Referring to FIG. 1, the display device 1000 may include a pixel unit 100, a scan driver 200, an emission driver 300, a data driver 400, a controller 500, and a power supply 600.

The pixel unit 100 may include scan lines S11 to S1*n*, S21 to S2*n*, and S31 to S3*n*, emission control lines E1 to En, data lines D1 to Dm, and pixels PX coupled to the scan lines S11 to S1*n*, S21 to S2*n*, and S31 to S3*n*, the emission control lines E1 to En, and the data lines D1 to Dm (here, each of m and n is an integer of 1 or greater). Each of the pixels PX may include a driving transistor and a plurality of switching transistors. To prevent current leakage from occurring in the pixels PX during a low-frequency driving operation, the power supply 600 may supply a reference voltage Vref to the pixels PX.

The display device 1000 may display images at various frame frequencies (herein also referred to as refresh rates, or driving frequencies) depending on a mode of operation and/or a driving condition. A frame frequency FF may be a frequency at which data voltages are substantially applied to the driving transistor of the pixel PX per a unit time, for example, per second. For example, the frame frequency FF may also be referred to as "scan rate" or "refresh frequency" and indicate the number of images displayed per the unit time.

In an embodiment, the frame frequency FF may be an output frequency of a first scan signal supplied to the data driver 400 and/or a first scan line S1*i* of an i-th pixel row. For example, the frame frequency FF for driving a video may be approximately 60 Hz or higher (e.g., 120 Hz). In this case, the first scan signal S1*i* may be supplied to each horizontal line (pixel row) sixty times per second.

In an embodiment, the display device 1000 may adjust, depending on a mode of operation and/or a driving condition, output frequencies of the scan driver 200 and the emission driver 300 and an output frequency of the data driver 400 corresponding thereto. For example, the display device 1000 may display images or videos in response to various frame frequencies ranging from 1 Hz to 120 Hz. However, this is only for illustrative purposes. For example, the display device 1000 may display images at the frame frequency FF (e.g., 240 Hz or 480 Hz) greater than 120 Hz.

The controller 500 may generate a first control signal SCS, a second control signal ECS, a third control signal DCS, and a fourth control signal PCS based on a data enable signal DE, a vertical synchronization signal Vsync, and a horizontal synchronization signal Hsync that are supplied from an external device. The vertical synchronization signal Vsync may divide an image signal RGB on a frame basis. The horizontal synchronization signal Hsync may divide the image signal RGB on a horizontal line (pixel row) basis. The data enable signal DE may distinguish an active period from a blank period, and the controller 500 may receive the image signal RGB or image data DAT in each frame during an active period. For example, the controller 500 may substantially receive the image signal RGB during an active period.

The controller 500 may supply the first control signal SCS to the scan driver 200, may supply the second control signal ECS to the emission driver 300, may supply the third control signal DCS to the data driver 400, and may supply the fourth control signal PCS to the power supply 600. In one embodiment, the controller 500 may receive the image signal RGB from an external device, change a format of the image signal RGB or rearrange the image signal RGB into the image data DAT suitable for the display device 1000, and supply the image data DAT to the data driver 400.

In an embodiment, the first control signal SCS may include one or more control signals, and the scan driver 200 may respectively control transmission of a first scan signal to the first scan lines S11 to S1*n*, a second scan signal to the second scan lines S21 to S2*n*, a third scan signal to the third scan lines S31 to S3*n*.

In an embodiment, the controller 500 may generate reference voltage data RVD corresponding to the reference voltage Vref based on the frame frequency FF for driving the pixel unit 100 and supply the reference voltage data RVD to the power supply 600. In this case, a value of the reference voltage Vref may be adjusted depending on the frame frequency FF of the pixel unit 100.

In an embodiment, the controller 500 may generate the reference voltage data RVD with reference to a representative value of a grayscale of the image signal RGB (or the image data DAT) and the frame frequency FF. For example, in a case where the frame frequency FF for the representative value of the grayscale of the same image data DAT is changed from a first frequency to a second frequency, the reference voltage Vref may vary. Furthermore, in a case where the representative value of the grayscale of the image data DAT for the same frame frequency FF is changed from a first value to a second value, the reference voltage Vref may vary.

The scan driver 200 may receive the first control signal SCS from the controller 500, and supply the first scan signal, the second scan signal, and the third scan signal respectively to the first scan lines S11 to S1*n*, the second scan lines S21 to S2*n*, and the third scan lines S31 to S3*n*, based on the first control signal SCS.

Each of the first to third scan signals may be set to a gate-on voltage (e.g., a low voltage). A transistor of the pixel PX that receives a scan signal may be set to a turn-on state when the scan signal of the gate-one voltage is supplied thereto.

The emission driver 300 may supply emission control signals to the emission control lines E1 to En, based on the second control signal ECS. For example, the emission control signals may be successively supplied to the emission control lines E1 to En.

The emission control signals each may be set to be a gate-off level (e.g., a high voltage). A transistor of the pixel PX that receives an emission control signal may be turned off during an emission period, for example, when the emission control signal is supplied thereto, and may be turned on during other periods.

Although FIG. 1 illustrates that each of the scan driver 200 and the emission driver 300 is illustrated as a single component, the present disclosure is not limited thereto. Depending on the design of the display device 1000, the scan driver 200 may include a plurality of scan drivers, each of which supplies at least one of the first to third scan signals. Furthermore, at least parts of the scan driver 200 and/or the emission driver 300 may be integrated into a single driving circuit, module, or the like.

The data driver 400 may receive the third control signal DCS and the image data DAT from the controller 500. The data driver 400 may convert digital image data DAT into an analog data signal (a data voltage). The data driver 400 may supply data signals (or data voltages) to the data lines D1 to Dm in response to the third control signal DCS.

The power supply 600 may supply, to the pixel unit 100, a first power supply voltage VDD, a second power supply voltage VSS, and the reference voltage Vref for driving the pixels PX. The power supply 600 may further generate an initialization voltage Vint (see FIG. 2) for initialization of the pixels PX. In an embodiment, the power supply 600 may generate the reference voltage Vref based on the reference voltage data RVD received from the controller 500. The reference voltage Vref may be adjusted based on the frame frequency FF of the pixel unit 100 and the representative value of the image signal RGB (or the representative value of the image data DAT).

The display device 1000 may be operated in one of a first mode (or a normal mode) in which data voltages are applied at a nominal frequency (e.g., 60 Hz) or higher to display a video or the like, and a second mode (or a low-power mode)

in which data voltages are applied at a frequency lower than the nominal frequency, for example, to display a static image.

Figure 2:
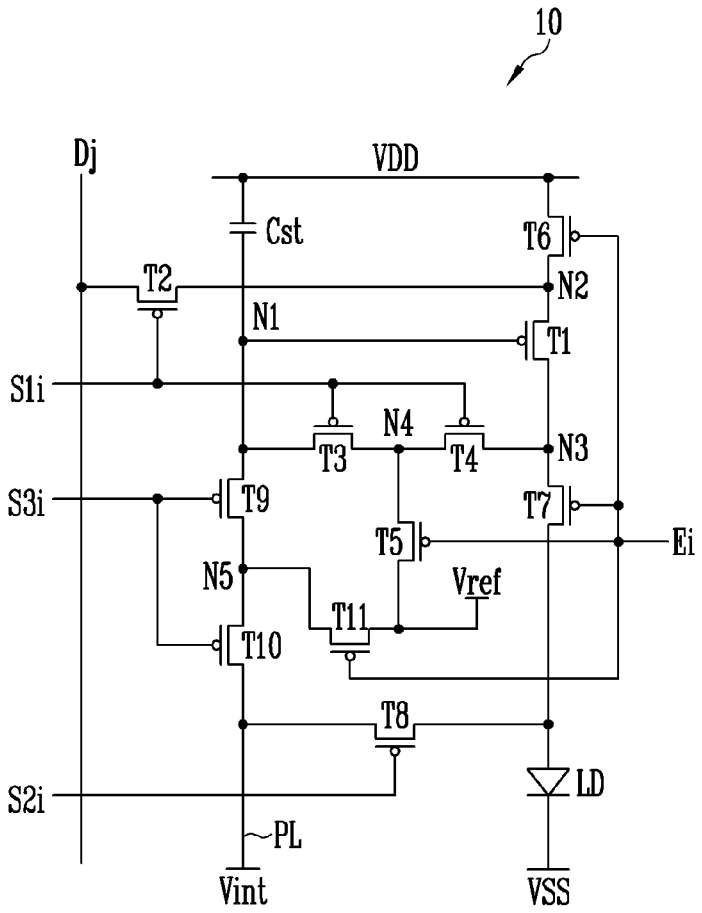
FIG. 2 is a circuit diagram illustrating an example of a pixel included in the display device of FIG. 1.
Figure 8:
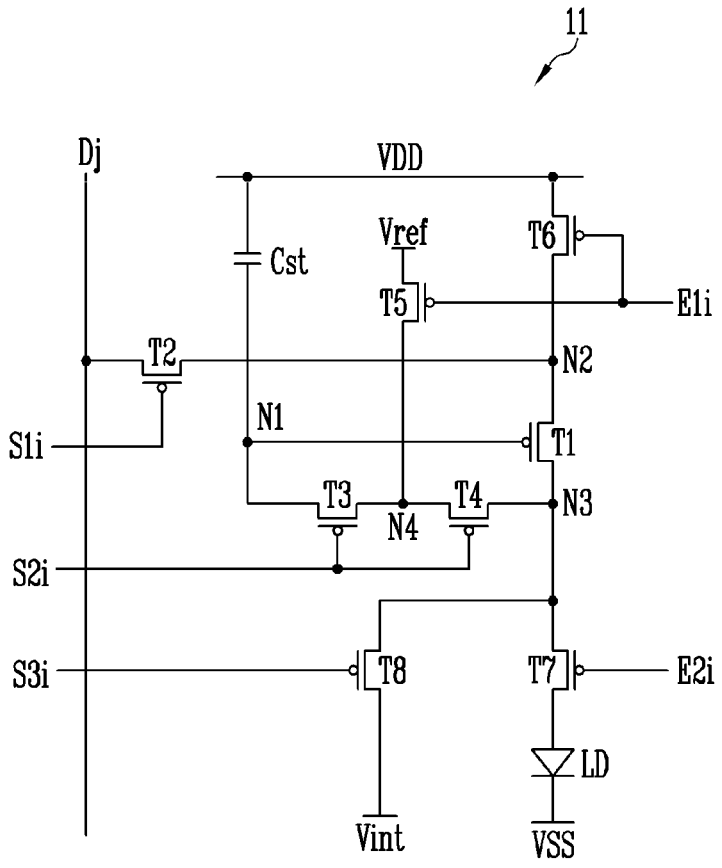
FIG. 8 is a circuit diagram illustrating another example of the pixel included in the display device of FIG. 1.

During a low-frequency driving operation of the second mode, leakage of driving current of a light emitting element of the pixel PX may occur, and image flicker may be visible due to the current leakage current. As will be explained in further detail below, the pixel PX having a circuit structure as illustrated in FIG. 2 or 8 may prevent or minimize current leakage during a low-frequency driving operation. In one embodiment, the image flicker in the low-frequency driving mode may be mitigated by supplying the reference voltage Vref to the pixel PX.

However, the leakage current of the pixel PX may vary depending on the data voltage. Furthermore, if the frame frequency FF changes even at the same data voltage, the leakage current may vary. The pixel PX may optimally control the leakage current by adjusting the reference voltage Vref based on the frame frequency FF and the data voltage (grayscale).

FIG. 2 is a circuit diagram illustrating an example of a pixel included in the display device 1000 of FIG. 1.

For the purpose of explanation, FIG. 2 illustrates a pixel 10 coupled to an i-th horizontal line (or an i-th pixel row) and an j-th data line Dj (here, i is a natural number less than or equal to n, and j is a natural number less than or equal to m).

The pixel 10 may include a light emitting element LD, first to eleventh transistors T1 to T11, and a storage capacitor Cst.

The light emitting element LD may include a first electrode (either an anode electrode or a cathode electrode) coupled to the seventh transistor T7, and a second electrode (the other one of the cathode electrode and the anode electrode) coupled to the second power supply voltage VSS. The light emitting element LD may generate light having a predetermined luminance corresponding to the amount of current supplied from the first transistor T1 (or the driving transistor).

In an embodiment, the light emitting element LD may be an organic light emitting diode including an organic light emitting layer. In an embodiment, the light emitting element LD may be an inorganic light emitting element formed of inorganic material. In an embodiment, the light emitting element LD may be a light emitting element formed of a combination of inorganic material and organic material. The light emitting element LD may include a plurality of inorganic light emitting elements coupled in parallel and/or series between the second power supply voltage VSS and the seventh transistor T7.

The first transistor T1 may be coupled between a second node N2 and a third node N3. A gate electrode of the first transistor T1 may be coupled to a first node N1. The first transistor T1 may control, in response to the voltage supplied to the first node N1, an amount of current (driving current) flowing from the first power supply voltage VDD to the second power supply voltage VSS via the light emitting element LD. To this end, the first power supply voltage VDD may be higher than the second power supply voltage VSS.

The second transistor T2 may be coupled between the j-th data line Dj (hereinafter, referred to as the data line) and the second node N2. A gate electrode of the second transistor T2 may be coupled to an i-th first scan line S1*i* (hereinafter, referred to as a first scan line). When a first scan signal is supplied to the first scan line S1*i*, the second transistor T2 may be turned on to electrically couple the data line Dj with the second node N2.

The third transistor T3 and the fourth transistor T4 may be coupled in series between the first node N1 and the third node N3. A gate electrode of the third transistor T3 and a gate electrode of the fourth transistor T4 may be coupled to the first scan line S1*i*. The third transistor T3 and the fourth transistor T4 may be turned on simultaneously with the second transistor T2 when the first scan signal is supplied to the first scan line S1*i*.

Here, due to a stacked structure of the transistors, a parasitic capacitance component may be present in a fourth node N4 and the first scan line S1*i*. To prevent current from undesirably leaking due to the parasitic capacitance, the fifth transistor T5 may be added to directly control the voltage of the fourth node N4.

The fifth transistor T5 may be coupled to the fourth node N4 between the third transistor T3 and the fourth transistor T4. The fifth transistor T5 may supply the reference voltage Vref to the fourth node N4. A gate electrode of the fifth transistor T5 may be coupled to the i-th emission control line Ei (hereinafter, referred to as the emission control line). The fifth transistor T5 may be turned off by an emission control signal (e.g., a high level) supplied to the emission control line Ei. The fifth transistor T5 may be turned on based on the emission control signal during the emission period and supply the reference voltage Vref to the fourth node N4.

In an embodiment, the reference voltage Vref may be a value in a range of data voltages determined by a grayscale range. For example, the reference voltage Vref may be a median value of the range of data voltages. Since the reference voltage Vref has a value between a black grayscale voltage and a white grayscale voltage, a source-drain voltage Vds of the third transistor T3 may be controlled to have a low level during the emission period. Therefore, a path of current flowing to the third and fourth transistors T3 and T4 during the emission period may be restrained, so that leakage of driving current can be reduced.

The sixth transistor T6 may be coupled between the first power supply voltage VDD and the second node N2. A gate electrode of the sixth transistor T6 may be coupled to the emission control line Ei. The seventh transistor T7 is coupled between the third node N3 and the light emitting element LD. A gate electrode of the seventh transistor T7 may be coupled to the emission control line Ei. The sixth transistor T6 and the seventh transistor T7 may be turned off during the emission period when the emission control signal is supplied to the emission control line Ei, and may be turned on during other periods.

The eighth transistor T8 may be coupled between a power line PL and the first electrode of the light emitting element LD. A gate electrode of the eighth transistor T8 may be coupled to an i-th second scan line S1*i* (hereinafter, referred to as a second scan line). The eighth transistor T8 may be turned on when the second scan signal is supplied to the second scan line S2*i* and transmit the initialization voltage Vint to the first electrode of the light emitting element LD.

The ninth transistor T9 and the tenth transistor T10 may be coupled in series between the first node N1 and the power line PL for transmitting the initialization voltage Vint. A gate electrode of the ninth transistor T9 and a gate electrode of the tenth transistor T10 may be coupled to an i-th third scan line S3*i* (hereinafter, referred to as a third scan line). The ninth transistor T9 and the tenth transistor T10 may be turned on when the third scan signal is supplied to the third scan line S3*i*, and transmit the initialization voltage Vint to the first node N1, or the gate electrode of the first transistor T1.

A parasitic capacitance component may be present in a fifth node N5 between the ninth transistor T9 and the tenth transistor T10, and the third scan line S3*i*. To prevent current from undesirably leaking due to the parasitic capacitance, the eleventh transistor T11 may directly control the voltage of the fifth node N5.

The eleventh transistor T11 may be coupled between the fifth node N5 and the reference voltage Vref. A gate electrode of the eleventh transistor T11 may be coupled to the emission control line Ei. The eleventh transistor T11 may be turned off by an emission control signal (e.g., a high level) supplied to the emission control line Ei. The eleventh transistor T11 may be turned on during the emission period and supply the reference voltage Vref to the fifth node N5.

The storage capacitor Cst may be coupled between the first power supply voltage VDD and the first node N1.

Figure 3:
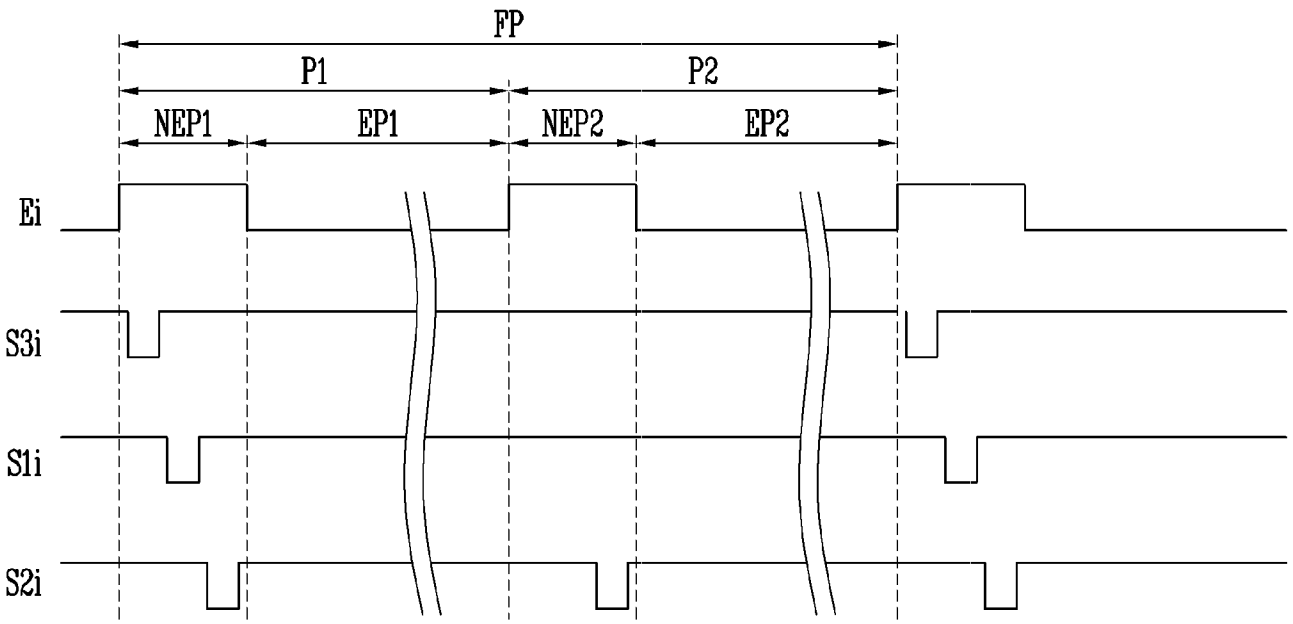
FIG. 3 is a timing diagram illustrating examples of signals supplied to the pixel of FIG. 2.

FIG. 3 is a timing diagram illustrating examples of signals supplied to the pixel of FIG. 2.

Referring to FIGS. 1 to 3, the frame frequency FF for driving the pixel 10 of the display device 1000 may vary depending on a mode of operation and/or a driving condition.

In an embodiment, during a variable frequency driving operation for controlling the frame frequency FF, each frame period FP may include a first period P1 and a second period P2. The first period P1 and the second period P2 may respectively include non-emission periods NEP1 and NEP2 and emission periods EP1 and EP2. During the first non-emission period NEP1, a data voltage may be applied to the pixel 10. During the second non-emission period NEP2, the data voltage may not be applied to the pixel 10. Therefore, during the second emission period EP2, the pixel 10 may emit light based on the data voltage supplied during the first non-emission period NEP1.

As illustrated in FIG. 3, the emission control signal and the second scan signal may be respectively supplied to the emission control line Ei and the second scan line S2*i* at the first frequency, and the first scan signal and the third scan signal may be respectively supplied to the first scan line S1*i* and the third scan line S3*i* at the second frequency that is lower than the first frequency. For example, the first frequency may be 120 Hz, and the second frequency may be 60 Hz. The frequency of the first scan signal may be substantially the same as the frame frequency FF.

However, this is only for illustrative purposes, and the second frequency may be 60 Hz or less. As the second frequency is reduced or a difference between the first frequency and the second frequency is increased, an iteration count of the second period P2 in the frame period FP may be increased. For example, depending on the frame frequency FF, the frame period FP may include one first period P1 and a plurality of successive second periods P2.

The emission control signal having a low level may be supplied to the emission control line Ei in the emission periods EP1 and EP2. Periods other than the emission periods EP1 and EP2 may correspond to the non-emission periods NEP1 and NEP2.

During the first non-emission period NEP1, the third scan signal, the first scan signal, and the second scan signal may be successively supplied to the third scan line S3*i*, the first scan line S1*i*, and the second scan line S2*i*, respectively.

When the third scan signal is supplied to the third scan line S3*i*, the ninth and tenth transistors T9 and T10 may be turned on, and the initialization voltage Vint may be supplied to the first node N1. Therefore, the gate voltage of the first transistor T1 may be initialized.

Thereafter, when the first scan signal is supplied, the second transistor T2, the third transistor T3, and the fourth transistor T4 may be turned on, and the first transistor T1 may be diode-connected. Therefore, data voltage application and threshold voltage compensation for the pixel 10 may be performed.

Subsequently, when the second scan signal is supplied, the eighth transistor T8 may be turned on, and the initialization voltage Vint may be supplied to the first electrode of the light emitting element LD, and the voltage of the first electrode of the light emitting element LD may be initialized.

Thereafter, during the first emission period EP1 when the supply of the emission control signal to the emission control line Ei is interrupted (e.g., a low-level emission control signal is supplied), the sixth transistor T6 and the seventh transistor T7 may be turned on, and the light emitting element LD may emit light. Furthermore, the fifth transistor T5 and the eleventh transistor T11 may be turned on, and the reference voltage Vref may be supplied to the fourth node N4 and the fifth node N5. Therefore, during the first emission period EP1, leakage of current flowing from the third node N3 to the first node N1 may be reduced or minimized.

Thereafter, only the second scan signal and the emission control signal may be supplied during the second non-emission period NEP2. In other words, during the second non-emission period NEP2, the voltage of the first electrode of the light emitting element LD may be initialized.

Subsequently, during the second emission period EP2, the light emitting element LD may emit light based on the data voltage that is supplied during the first non-emission period NEP1.

Since the iteration count of the second period P2 varies depending on the frame frequency FF, the leakage current may be changed. For example, as the frame frequency FF is reduced, the leakage current may be increased, and a reduction width in luminance may be increased. To mitigate variation in luminance due to leakage current in the second period P2 and reduce image flicker due to the variation in luminance, the reference voltage Vref may be controlled based on the frame frequency FF.

Figure 4:
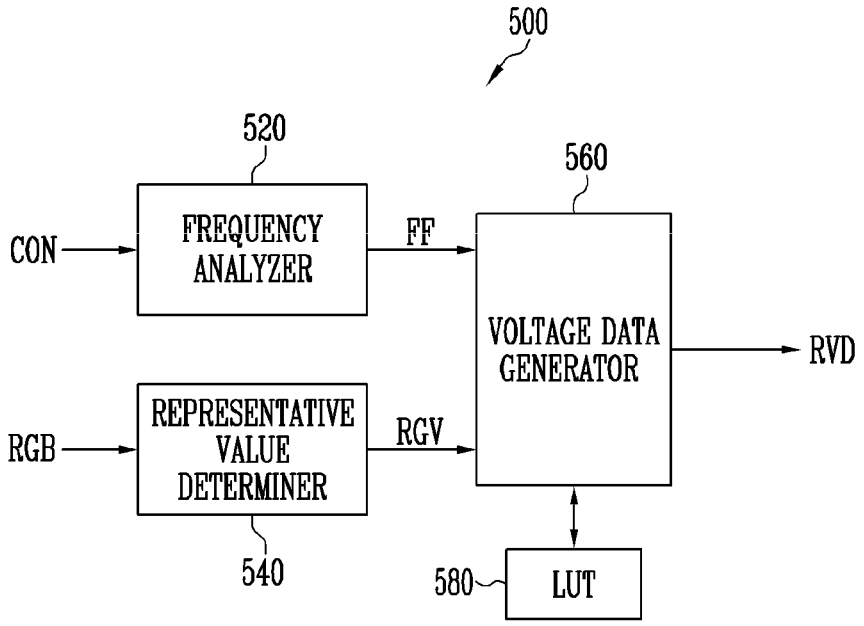
FIG. 4 is a block diagram illustrating an example of a controller included in the display device of FIG. 1.

FIG. 4 is a block diagram illustrating an example of the controller 500 included in the display device 1000 of FIG. 1.

Referring to FIGS. 1 and 4, the controller 500 may include a frequency analyzer 520, a representative value determiner 540, a voltage data generator 560, and a lookup table 580.

The controller 500 may generate the reference voltage data RVD corresponding to the reference voltage Vref based on the frame frequency FF.

The frequency analyzer 520 may determine the frame frequency FF based on a control signal CON supplied from an external device such as a graphic processor. The control signal CON may include the data enable signal DE, the vertical synchronization signal Vsync, a frequency variable signal, etc. The control signal CON may also include metadata including information about the frame frequency FF.

For example, the frequency analyzer 520 may calculate the frame frequency FF by detecting a time for which the data enable signal DE corresponding to one frame period is supplied. Alternatively, the frequency analyzer 520 may count the vertical synchronization signal Vsync and calculate the frame frequency FF based on the vertical synchronization signal Vsync.

However, this is only for illustrative purposes, and the frequency analyzer 520 may determine the frame frequency FF in various manners without departing from the scope of the present disclosure.

The representative value determiner 540 may determine a representative value RGV of a grayscale of a corresponding frame based on information about grayscales included in the image signal RGB or the image data DAT. In an embodiment, the representative value RGV may be an average value of grayscales included in the image signal RGB or the image data DAT.

Alternatively, the representative value determiner 540 may determine the representative value RGV based on an on-pixel ratio. In other words, the representative value determiner 540 may calculate the representative value RGV based on a ratio of pixels emitting light among all of the pixels or a ratio of the luminance of a current frame with respect to the maximum luminance.

However, this is only for illustrative purposes, and the representative value determiner 540 may determine the representative value RGV in various manners without departing from the scope of the present disclosure.

The voltage data generator 560 may generate the reference voltage data RVD based on the frame frequency FF and the representative value RGV. In an embodiment, the voltage data generator 560 may generate the reference voltage data RVD with reference to the lookup table 580 that sets values of the reference voltage Vref based on frequencies and grayscales.

The lookup table 580 may include the values of the reference voltage Vref to match with a predetermined frequency and each of a plurality of grayscales (i.e., representative values) corresponding to the frame frequency FF. The lookup table 580 may include a plurality of tables set for respective frequencies, and may be set and stored corresponding to characteristics of the display device 1000.

For example, in a case where the driving transistor of the pixel PX is a P-channel metal oxide semiconductor (PMOS) transistor, values of the reference voltage Vref that are stored in the lookup table 580 may be reduced as the grayscale corresponding to the representative value RGV for the same frame frequency FF is increased. Furthermore, the values of the reference voltage Vref that are stored in the lookup table 580 may be increased as the frame frequency FF for the same representative value RGV (or the same grayscale) is reduced. However, this is only for illustrative purposes, and relationship between the frame frequency FF, the grayscale, and the reference voltage Vref that is set in the lookup table 580 is not limited thereto. The relationship between the frame frequency FF, the grayscale, and the reference voltage Vref in the lookup table 580 may be set to correspond to the characteristics of the display device 1000 as determined by tests.

The voltage data generator 560 may supply the reference voltage data RVD to the power supply 600.

Figure 5:
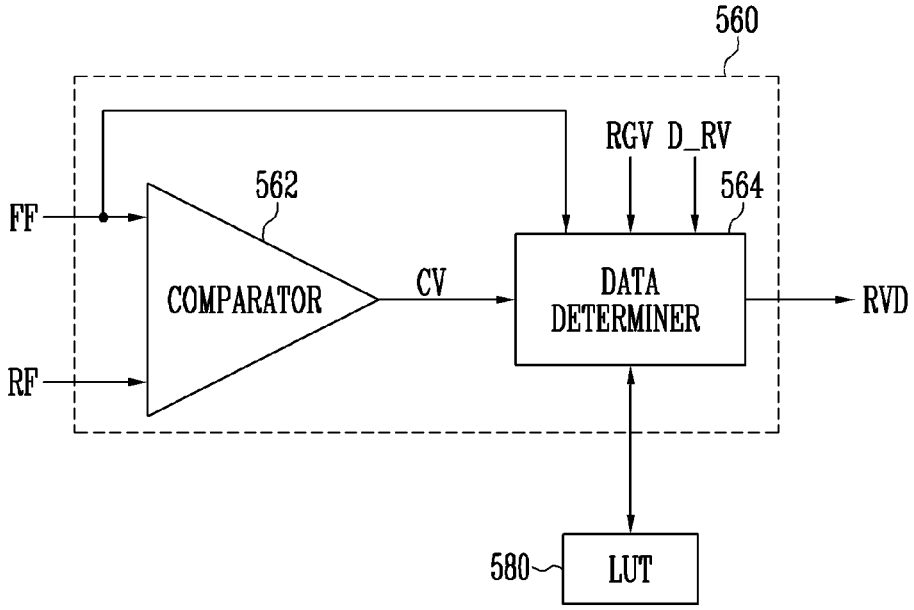
FIG. 5 is a block diagram illustrating an example of a voltage data generator included in the controller of FIG. 4.

FIG. 5 is a block diagram illustrating an example of the voltage data generator 560 included in the controller 500 of FIG. 4. FIG. 6 is a diagram illustrating an example of the lookup table 580 included in the controller 500 of FIG. 4.

Referring to FIGS. 1, 4, 5, and 6, the voltage data generator 560 may include a comparator 562 and a data determiner 564.

The comparator 562 may receive the frame frequency FF and a reference frequency RF. The comparator 562 may compare the frame frequency FF with the reference frequency RF. A comparison result CV may have two result values. For example, the comparison result CV may be a first result value indicating that the frame frequency FF is equal to or greater than the reference frequency RF, or a second result value indicating that the frame frequency FF is less than the reference frequency RF.

In an embodiment, the reference frequency RF may be set to a normal frame frequency (e.g., 60 Hz) of the display device 1000 for displaying an image, a video or the like.

The data determiner 564 may determine the reference voltage data RVD based on the comparison result CV. For example, the data determiner 564 may receive the frame frequency FF, a default value D_RV of the reference voltage data RVD, and the comparison result CV.

In an embodiment, if the frame frequency FF is equal to or greater than the reference frequency RF, the data determiner 564 may output the default value D_RV of the reference voltage data RVD that corresponds to a default value of the reference voltage Vref. In a case where the frame frequency FF is a high frequency that is equal to or greater than the reference frequency RF, image flicker due to current leakage may not be recognized. In this case, the reference voltage Vref may not be adjusted depending on the average grayscale of the frame and/or the frame frequency FF.

In other words, if the frame frequency FF is equal to or greater than the reference frequency RF, the data determiner 564 of the controller 500 may output the reference voltage data RVD having the default value D_RV, and the power supply 600 may supply the reference voltage Vref having the default value to the pixel unit 100 regardless of the frame frequency FF and the representative value RGV.

On the other hand, if the frame frequency FF is less than the reference frequency RF, the data determiner 564 may determine the reference voltage data RVD with reference to the lookup table 580.

In other words, the data determiner 564 may directly output the reference voltage data RVD corresponding to the default value D_RV or output the reference voltage data RVD corresponding to the frame frequency FF with reference to the lookup table 580 based on the comparison result CV. For example, the comparison result CV provided to the data determiner 564 may be used to select either the frame frequency FF or the default value D_RV.

If the default value D_RV is selected according to the comparison result CV, the data determiner 564 may directly output the reference voltage data RVD corresponding to the default value D_RV. If the frame frequency FF is selected according to the comparison result CV, the data determiner 564 may output the reference data RVD corresponding to the frame frequency FF based on the lookup table 580.

Referring to FIG. 6, the lookup table 580 may include a plurality of lookup tables including a first lookup table LUT1, a second lookup table LUT2, and a third lookup table LUT3. The lookup tables LUT1, LUT2, and LUT3 may be distinguished from each other based on the frame frequency FF. For example, the first lookup table LUT1 corresponds to the frame frequency FF of 30 Hz, the second lookup table LUT2 corresponds to the frame frequency FF of 20 Hz, and the third lookup table LUT3 corresponds to the frame frequency FF of 10 Hz. Furthermore, each of the lookup tables LUT1, LUT2, and LUT3 may include values of the reference voltage data RVD that match with a preset grayscale or a grayscale range. Each of the values of the reference voltage data RVD may be a code or a register value corresponding to the reference voltage Vref that the power supply 600 may output. The values of the reference voltage data RVD may also be expressed in a digital form.

For example, in a case where the frame frequency FF is 30 Hz and the representative value RGV is grayscale 2, the data determiner 564 may extract the value of the reference voltage Vref as "4" from the first lookup table LUT1. The data determiner 564 may output digital reference voltage data RVD corresponding to the value 4 as the reference voltage Vref.

In an embodiment, the data determiner 564 may extract a plurality of reference values from the lookup table 580 based on the frame frequency FF and the representative value RGV, and calculate the reference voltage data RVD by interpolating the extracted reference values. In a case where the frame frequency FF and/or the representative value RGV are not set in the lookup table 580, the data determiner 564 may interpolate a plurality of reference voltages according to a predetermined algorithm and calculate the reference voltage data RVD and a corresponding value of the reference voltage Vref based on the frame frequency FF and the representative value RGV. The data determiner 564 may include a circuit and/or a software algorithm for calculating the value of the reference voltage Vref. In this case, the size of the lookup table 580 may be reduced.

For example, in a case where the frame frequency FF is 25 Hz and the representative value RGV is grayscale 2, the data determiner 564 may extract a first reference value from the first lookup table LUT1 that corresponds to the frame frequency FF of 30 Hz and extract a second reference value from the second lookup table LUT2 that corresponds to the frame frequency FF of 20 Hz. The data determiner 564 may determine the reference voltage data RVD by operation such as interpolation using the first reference value and the second reference value.

As such, the display device 1000 in accordance with an embodiment of the present disclosure may control the reference voltage Vref based on the frame frequency FF and the representative value RGV of the grayscale of the corresponding frame frequency FF. Therefore, the display device 1000 is capable of reducing or minimizing leakage current in the pixel PX and mitigate image flicker by controlling the reference voltage Vref in response to variation in the frame frequency FF.

Furthermore, since the leakage current may be minimized depending on the frame frequency FF, the display device 1000 is capable of displaying a static image at a very low frequency. Hence, the display device 1000 may provide a reliable low-power driving operation while reducing the power consumption.

Figure 7:
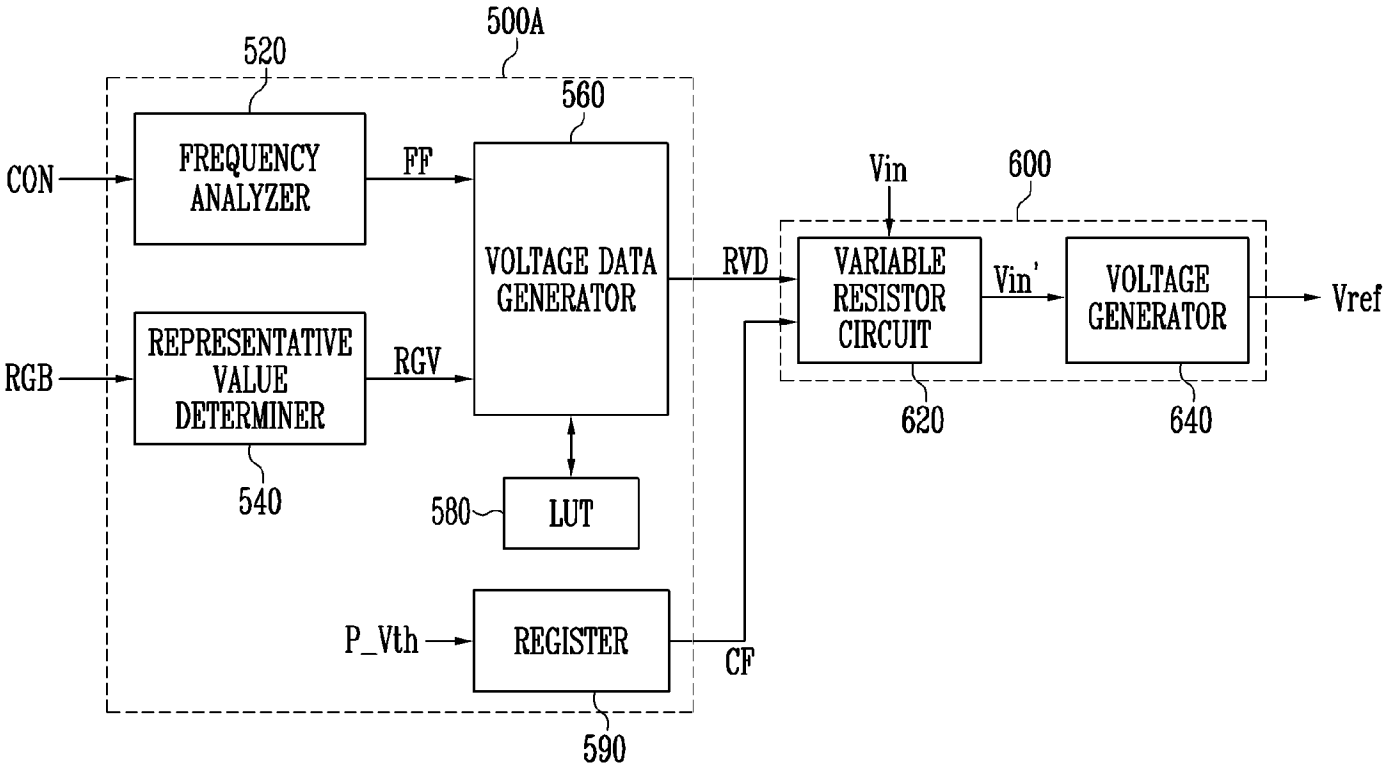
FIG. 7 is a block diagram illustrating examples of a controller and a power supply included in the display device of FIG. 1.

FIG. 7 is a block diagram illustrating examples of another controller and the power supply 600 included in the display device 1000 of FIG. 1.

The configuration and operation of a controller 500A of FIG. 7 are substantially the same as those of the controller 500 described with reference to FIGS. 4 to 6 other than a register 590. Therefore, like reference numerals will be used to designate like or similar components, and repetitive explanation will be omitted.

Referring to FIGS. 1 and 7, the controller 500A may include the frequency analyzer 520, the representative value determiner 540, the voltage data generator 560, the lookup table 580, and the register 590. The power supply 600 may include a variable resistor circuit 620 and a voltage generator 640.

The register 590 may output a compensation factor CF that reflects a threshold voltage distribution P_Vth of the driving transistors (e.g., the first transistor T1 of FIG. 2) of the pixels PX. The threshold voltage distribution P_Vth may be determined by a test during a process of manufacturing the display device 1000. The threshold voltage distribution P_Vth may be intrinsic characteristics of the display device 1000. For example, the threshold voltage distribution P_Vth may be an average of threshold voltages of one or more driving transistors of the pixels PX included in the display device 1000 or a deviation between a reference value and the average. The register 590 may output the compensation factor CF corresponding to the threshold voltage distribution P_Vth. The compensation factor CF may be digital data capable of adjusting the reference voltage Vref.

The power supply 600 may output the reference voltage Vref based on the reference voltage data RVD and the compensation factor CF.

The variable resistor circuit 620 included in the power supply 600 may adjust a resistance value based on the reference voltage data RVD, and change the voltage of an input power supply voltage Vin based on the resistance value. In an embodiment, the variable resistor circuit 620 may adjust the resistance value by further reflecting the compensation factor CF.

In an embodiment, the variable resistor circuit 620 may be implemented as a digital potentiometer. The digital potentiometer may store information related to the reference voltage Vref corresponding to the reference voltage data RVD. Here, the information stored in the digital potentiometer may be updated or changed by the controller 500, the power supply 600, or the like.

The reference voltage data RVD and the compensation factor CF may be used to adjust the input power supply voltage Vin by increasing or reducing the resistance value of the variable resistor circuit 620. For example, as the resistance value of the digital potentiometer is increased, the value of the reference voltage Vref may be increased. Here, the input power supply voltage Vin may be supplied from a battery or the like.

The variable resistor circuit 620 provides an input voltage Vin' adjusted by the variable resistance to the voltage generator 640. The voltage generator 640 may generate the reference voltage Vref based on the adjusted input voltage Vin'. For example, the voltage generator 640 may include a boost converter and/or a buck converter configured to adjust the level of the input voltage Vin'.

As such, since the threshold voltage distribution P_Vth of the driving transistors of the pixels PX is additionally reflected in determining the reference voltage Vref, the reference voltage Vref may be controlled based on the characteristics of the display device 1000. Therefore, the display device 1000 may mitigate image flicker for various frame frequencies FF.

FIG. 8 is a circuit diagram illustrating another example of the pixel included in the display device 1000 of FIG. 1.

For the purpose of explanation, FIG. 8 illustrates a pixel 11 coupled to an i-th horizontal line (or an i-th pixel row) and an j-th data line Dj (here, i is a natural number less than or equal to n, and j is a natural number less than or equal to m).

The pixel 11 is substantially the same or similar to the pixel 10 described with reference to FIG. 2 other than some transistors and signal lines. Therefore, like reference numerals will be used to designate components, and repetitive explanation will be omitted.

Referring to FIG. 8, the pixel 11 may include the light emitting element LD, first to eighth transistors T1 to T8, and the storage capacitor Cst.

The first transistor T1 may control, in response the voltage supplied to the first node N1, the amount of current flowing from the first power supply voltage VDD to the second power supply voltage VSS via the light emitting element LD. The second transistor T2 may electrically couple the data line Dj with the second node N2 in response to a first scan signal supplied to the first scan line S1*i*.

The third transistor T3 and the fourth transistor T4 may be coupled in series between the first node N1 and the third node N3. A gate electrode of the third transistor T3 and a gate electrode of the fourth transistor T4 may be coupled to the second scan line S2*i*.

The fifth transistor T5 may be coupled to the fourth node N4 between the third transistor T3 and the fourth transistor T4. The fifth transistor T5 may supply the reference voltage Vref to the fourth node N4. A gate electrode of the fifth transistor T5 may be coupled to an i-th first emission control line Eli (hereinafter, referred to as a first emission control line). The fifth transistor T5 may be turned off by the first emission control signal (a high level) supplied to the first emission control line Eli.

The sixth transistor T6 may be coupled between the first power supply voltage VDD and the second node N2. A gate electrode of the sixth transistor T6 may be coupled to the first emission control line Eli.

The seventh transistor T7 is coupled between the third node N3 and the light emitting element LD. A gate electrode of the seventh transistor T7 may be coupled to an i-th second emission control line E2*i* (hereinafter, referred to as a second emission control line). The seventh transistor T7 may be turned off by the second emission control signal (a high level) supplied to the second emission control line E2*i*.

In other words, the sixth transistor T6 and the seventh transistor T7 may be controlled by different emission control signals. In an embodiment, the second emission control signal may be supplied later than the first emission control signal. For example, the same emission control signal may be supplied to the second emission control line E2*i* and an (i+2)-th first emission control line (indicated as E1*i*+2 in FIG. 9).

The eighth transistor T8 may supply the initialization voltage Vint to the third node N3. A gate electrode of the eighth transistor T8 may be coupled to the third scan line S3*i*. The eighth transistor T8 may be turned on by a third scan signal supplied to the third scan line S3*i* and supply the initialization voltage Vint to the third node N3.

Figure 9:
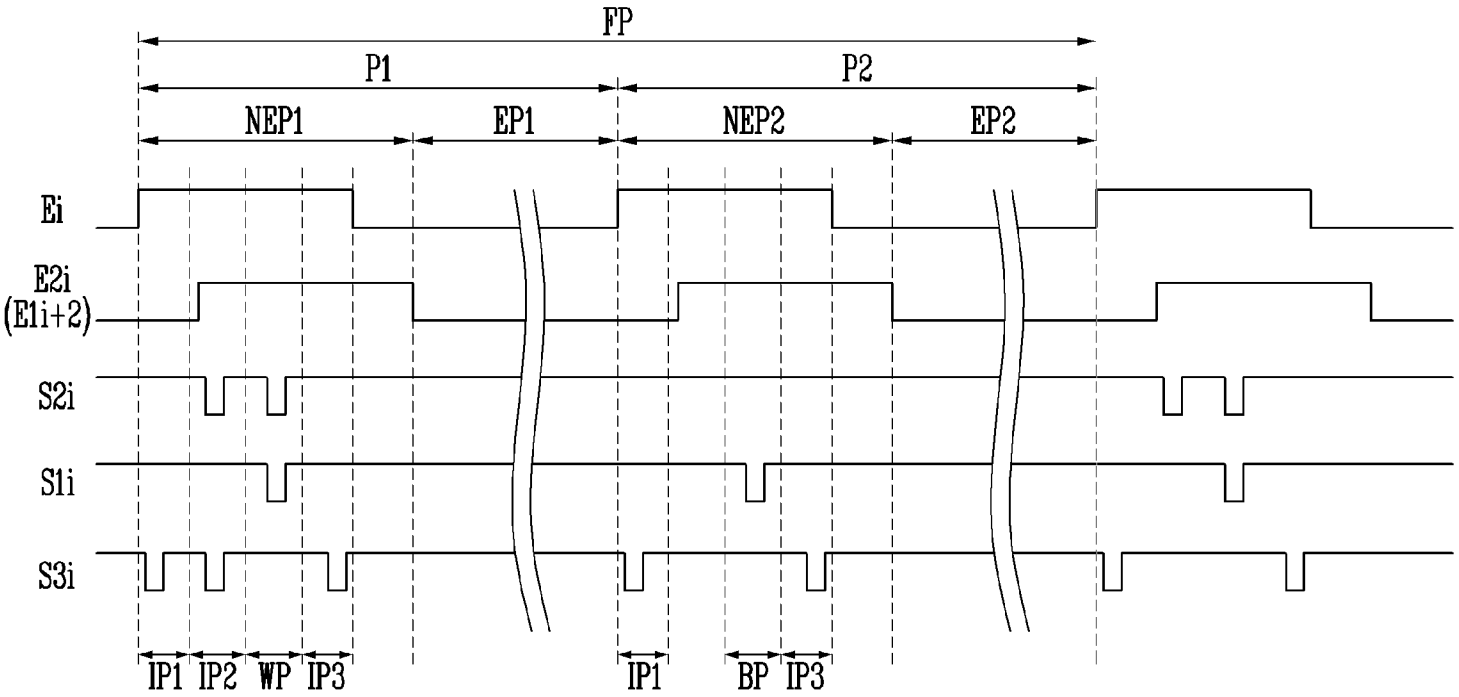
FIG. 9 is a timing diagram illustrating examples of signals supplied to the pixel of FIG. 8.

FIG. 9 is a timing diagram illustrating examples of signals supplied to the pixel 11 of FIG. 8.

In the description of FIG. 9, repetitive explanation that is already described with reference to FIG. 3 will be omitted.

Referring to FIGS. 1, 8, and 9, during a variable frequency driving operation for controlling the frame frequency FF, each frame period FP may include the first period P1 and the second period P2.

The first emission control signal, the second emission control signal, the first scan signal, and the third scan signal may be respectively supplied to the first emission control line Ei, the second emission control line E2*i*, the first scan line S1*i*, and the third scan line S3*i* at a first frequency. The second scan signal may be supplied to the second scan line S2*i* at a second frequency that is lower than the first frequency. For example, the second scan signal may be supplied only during the first period P1. The frequency of the second scan signal may be substantially the same as the frame frequency FF.

As the second frequency is reduced or a difference between the first frequency and the second frequency is increased, an iteration count of the second period P2 in the frame period FP may be increased. For example, depending on the frame frequency FF, the frame period FP may include one first period P1 and a plurality of successive second periods P2.

During the first non-emission period NEP1, the first emission control signal (a high level) and the second emission control signal (a high level) may be successively supplied. For example, the second emission control signal may be the same as the first emission control signal supplied to the (i+2)-th first emission control line E1*i*+2. In this case, the first emission control signal and the second emission control signal may have a time difference of two horizontal periods.

The first non-emission period NEP1 may include a first initialization period IP1, a second initialization period IP2, a write period WP, and a third initialization period IP3.

When the first emission control signal is supplied to the first emission control line Eli, the fifth transistor T5 and the sixth transistor T6 may be turned off.

Thereafter, the third scan signal may be supplied to the third scan line S3*i* during the first initialization period IP1. The eighth transistor T8 may be turned on in response to the third scan signal, and the initialization voltage Vint may be supplied to the first electrode of the light emitting element LD through the seventh transistor T7 that is in the turned-on state. Therefore, during the first initialization period IP1, the anode voltage of the light emitting element LD may be initialized.

During the second initialization period IP2, the second scan signal may be supplied to the second scan line S2*i*, and the third scan line may be supplied to the third scan line S3*i*. Hence, the third transistor T3, the fourth transistor T4, and the eighth transistor T8 may be turned on, and the initialization voltage Vint may be supplied to the first node N1 and the anode of the light emitting element LD again. Therefore, the gate voltage of the first transistor T1 and the anode voltage of the light emitting element LD may be initialized.

Thereafter, during the write period WP, the first scan signal may be supplied to the first scan line S1*i*, and the second scan signal may be supplied to the second scan line S2*i*. During the write period WP, the second transistor T2, the third transistor T3, and the fourth transistor T4 may be turned on, and the first transistor T1 may be diode-connected. Therefore, data voltage application and threshold voltage compensation for the pixel 11 may be performed.

Thereafter, a third scan signal may be supplied to the third scan line S3*i* during the third initialization period IP3. When the eighth transistor T8 is turned on, the initialization voltage Vint may be supplied to the third node N3. Therefore, the drain voltage of the first transistor T1 (in a case where the first transistor T1 is a PMOS transistor) may be initialized. Since the voltage of the third node N3 that has been increased by the threshold voltage compensation is reduced by the initialization voltage Vint, an increase in luminance of a black grayscale may be minimized.

Thereafter, during the first emission period EP1, the supply of the first emission control signal and the supply of the second emission control signal may be successively interrupted (a low level), and the sixth transistor T6 and the seventh transistor T7 may be successively turned on. Therefore, the emission element LD may emit light. Furthermore, the fifth transistor T5 may be turned, and the reference voltage Vref may be supplied to the fourth node N4. Therefore, during the first emission period EP1, leakage of current flowing from the third node N3 to the first node N1 may be minimized.

During the second non-emission period NEP2, the first emission control signal, the second emission control signal, the first scan signal, and the third scan signal may be respectively supplied to the first emission control line Ei, the second emission control line E2*i*, the first scan line S1*i*, and the third scan line S3*i*, and the second scan signal may not be supplied to the second scan line S2*i*. The second non-emission period NEP2 may include the first initialization period IP1, a bias period BP, and the third initialization period IP3. The operation of the first initialization period IP1 and the third initialization period IP3 may be substantially the same as the operation of the first initialization period IP1 and the third initialization period IP3 during the first non-emission period NEP2.

During the second non-emission period NEP2, the light emitting element LD may emit light based on a voltage of the first node N1 that is supplied by the data voltage during the first non-emission period NEP1. Therefore, the second initialization period IP2 may be omitted.

During the bias period BP, the first scan signal is supplied to the first scan line S1*i*, and the second transistor T2 may be turned on. The data voltage may be supplied to the second node N2 by turning on the second transistor T2. Hence, the first transistor T1 may be on-biased, and hysteresis characteristic variation of the first transistor T1 and variation in emission luminance due to a low-frequency driving operation may be minimized.

Subsequently, during the third initialization period IP3, the initialization voltage Vint may be supplied to the third node N3.

During the second emission period EP2, the light emitting element LD may emit light based on the data voltage supplied during the first non-emission period NEP1.

However, this is only for illustrative purposes, and the structure of the pixel 11 for variable frame frequency FF driving and timings of the scan signals and the emission control signals to be supplied to the pixel 11 are not limited thereto.

Since the iteration count of the second period P2 may vary depending on the frame frequency FF, the leakage current may be changed. To mitigate variation in luminance due to the leakage current during the second period P2 and image flicker resulting from the variation in luminance, as described with reference to FIGS. 4 to 7, the controller 500 (or the controller 500A) of the display device 1000 may control the reference voltage Vref depending on the frame frequency FF.

Figure 10:
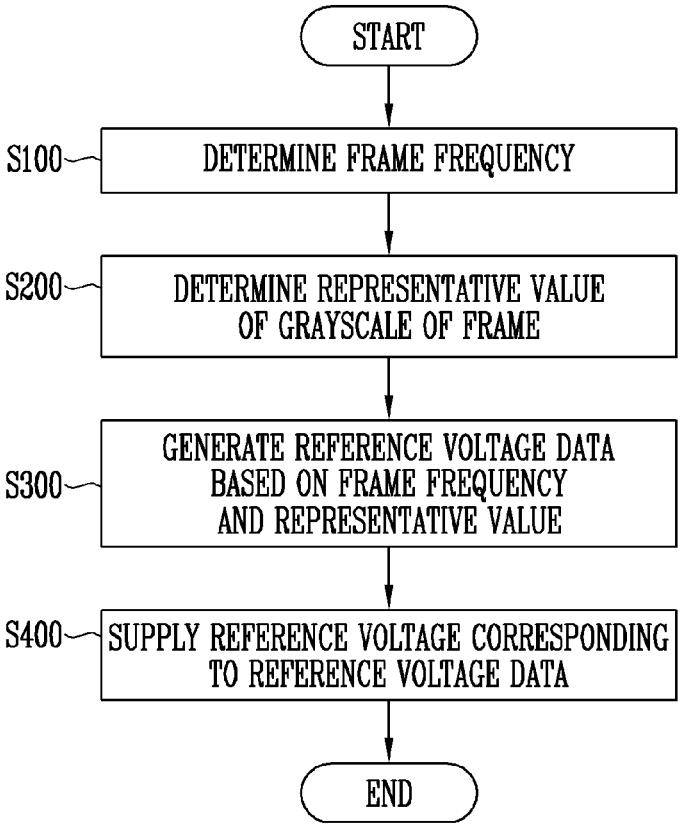
FIG. 10 is a flowchart illustrating a method of driving a display device in accordance with an embodiment of the present disclosure.
Figure 11:
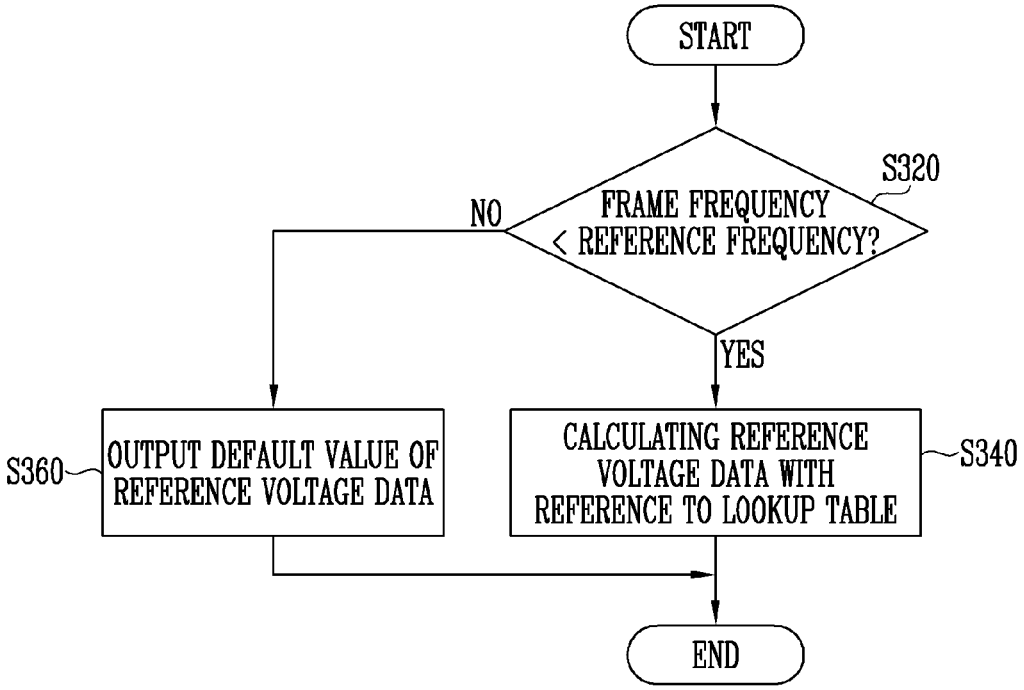
FIG. 11 is a flowchart illustrating an example of a method of generating reference data in accordance with an embodiment of the present disclosure.

FIG. 10 is a flowchart illustrating a method of driving a display device in accordance with an embodiment of the present disclosure. FIG. 11 is a flowchart illustrating an example of a method of generating reference data in accordance with an embodiment of the present disclosure.

Referring to FIGS. 10 and 11, the method of driving the display device 1000 may include: step S100 of determining the frame frequency FF; step S200 of determining the representative value RGV of a grayscale of a frame; step S300 of generating the reference voltage data RVD corresponding to the reference voltage Vref based on the frame frequency FF and the representative value RGV; and step S400 of supplying the reference voltage Vref to the pixel PX based on the reference voltage data RVD.

The frame frequency FF may be determined based on at least one of a data enable signal DE and the vertical synchronization signal Vsync (at step S100).

The representative value RGV of the grayscale of the frame may be determined based on grayscales included in the image data DAT of the frame. For example, the representative value RGV may be an average of grayscales of the frame.

The reference voltage data RVD may be generated based on the detected frame frequency FF and the calculated representative value RGV (at step S300).

Referring to FIG. 11, the frame frequency FF and the reference frequency RF may be compared with each other (at step S320). In a case where the frame frequency FF is equal to or greater than the reference frequency RF, the default value of the reference voltage data RVD may be output regardless of the frame frequency FF and the representative value RGV (at step S360). In a case where the frame frequency FF is less than the reference frequency RF, the reference voltage data RVD corresponding to the frame frequency FF and the representative value RGV may be calculated with reference to the lookup table 580 (at step S340).

Furthermore, the reference voltage Vref may be supplied to the pixel PX based on the reference voltage data RVD (at step S400).

The method of driving the display device 1000 has been described with reference to FIGS. 1 to 9; therefore repetitive description thereof will be omitted.

As described above, in the display device 1000 and the method of driving the display device 1000 in accordance with an embodiment of the present disclosure, the reference voltage Vref may be controlled based on the frame frequency FF and the representative value RGV of the grayscale of the corresponding frame. Therefore, when the display device 1000 may minimize the leakage current in the pixel PX and mitigate image flicker by controlling the reference voltage Vref in response to variation in the frame frequency FF.

Furthermore, since leakage current may be minimized depending on the frame frequency FF, the display device 1000 may display a static image at a very low frequency. Hence, the display device 1000 may implement a reliable low-power driving operation while reducing the power consumption.

While embodiments of the present disclosure have been described above with reference to various embodiments, those skilled in the art will appreciate that various modifications, additions and substitutions are possible, without departing from the scope and spirit of the present disclosure including the appended claims.

What is claimed is:

1. A display device comprising:

a pixel configured to display an image based on image data and a reference voltage;

a controller configured to generate reference voltage data corresponding to the reference voltage for restraining leakage current in the pixel based on a frame frequency; and a power supply configured to generate the reference voltage based on the reference voltage data and supply the reference voltage to the pixel, wherein the controller further comprises a register configured to output a compensation factor in which a distribution of threshold voltages of a driving transistor of the pixel is reflected, and wherein the power supply outputs the reference voltage based on the reference voltage data and the compensation factor.

2. The display device according to claim 1, wherein the power supply comprises:

a variable resistor circuit configured to adjust a resistance value based on the reference voltage data, and change an input power voltage based on the resistance value.

3. A display device comprising:

a pixel configured to display an image based on image data and a reference voltage;

a controller configured to generate reference voltage data corresponding to the reference voltage for restraining leakage current in the pixel based on a frame frequency; and a power supply configured to generate the reference voltage based on the reference voltage data and supply the reference voltage to the pixel, wherein the controller determines the reference voltage data with further reference to a representative value of a grayscale of the image data.

4. The display device according to claim 3, wherein the representative value is an average of grayscales included in the image data of a frame.

5. The display device according to claim 3, wherein for the representative value being the same, the reference voltage changes as the frame frequency changes from a first frequency to a second frequency.

6. The display device according to claim 5, wherein for the frame frequency being the same, the reference voltage changes as the representative value changes from a first value to a second value.

7. The display device according to claim 3, wherein the controller comprises:

a frequency analyzer configured to determine the frame frequency based on at least one of a vertical synchronization signal and a data enable signal supplied from an external device;

a representative value determiner configured to determine the representative value based on grayscales included in the image data; and a voltage data generator configured to generate the reference voltage data with reference to a lookup table that stores values of the reference voltage corresponding to the frame frequency and the grayscale.

8. The display device according to claim 7, wherein the voltage data generator comprises:

a comparator configured to compare the frame frequency and a reference frequency; and a data determiner configured to determine the reference voltage data based on a result of comparison of the comparator.

9. The display device according to claim 8, wherein, for the frame frequency being equal to or greater than the reference frequency, the data determiner outputs a default value of the reference voltage data corresponding to a default value among the values of the reference voltage, and wherein, for the frame frequency being less than the reference frequency, the data determiner determines the reference voltage data with reference to the lookup table.

10. The display device according to claim 8, wherein the data determiner extracts a plurality of reference values from the lookup table based on the frame frequency and the representative value, and calculates the reference voltage data by interpolating the reference values.

11. A display device comprising:

a pixel configured to display an image based on image data and a reference voltage;

a controller configured to generate reference voltage data corresponding to the reference voltage for restraining leakage current in the pixel based on a frame frequency;

a power supply configured to generate the reference voltage based on the reference voltage data and supply the reference voltage to the pixel;

a data driver configured to supply a data voltage to the pixel through a data line based on the image data;

a scan driver configured to supply a first scan signal to the pixel through a first scan line, supply a second scan signal to a second scan line; and an emission driver configured to supply a first emission control signal to the pixel through a first emission control line, wherein the pixel comprises:

a light emitting element;

a first transistor configured to control driving current based on a voltage of a first node and being coupled between a second node and a third node;

a second transistor coupled between the data line and the second node, and configured to be turned on by the first scan signal supplied to the first scan line;

a third transistor and a fourth transistor coupled in series between the first node and the third node and configured to be turned on by the second scan signal supplied to the second scan line;

a fifth transistor configured to supply the reference voltage to a fourth node between the third transistor and the fourth transistor and to be turned off by the first emission control signal supplied to the first emission control line; and a sixth transistor coupled between a first power supply voltage and the second node and configured to be turned off by the first emission control signal.

12. The display device according to claim 11, wherein the scan driver is further configured to supply a third scan signal to the pixel through a third scan line and supply a fourth scan signal to the pixel through a fourth scan line, and wherein the pixel further comprises:

a seventh transistor coupled between the third node and the light emitting element, and configured to be turned off by the first emission control signal;

an eighth transistor configured to supply an initialization voltage to the light emitting element and to be turned on by the third scan signal supplied to the third scan line;

a ninth transistor and a tenth transistor coupled in series between the first node and a power line for supplying the initialization voltage, and configured to be turned on by the fourth scan signal supplied to the fourth scan line; and an eleventh transistor configured to supply the reference voltage to a fifth node between the ninth transistor and the tenth transistor, and to be turned off by the first emission control signal.

13. The display device according to claim 12, wherein an identical scan signal is supplied to the first scan line and the second scan line.

14. The display device according to claim 11, wherein the scan driver is further configured to supply a third scan signal to the pixel through a third scan line, wherein the emission driver is further configured to supply a second emission control signal to the pixel through a second emission control line, and wherein the pixel further comprises:

a seventh transistor coupled between the third node and the light emitting element, and configured to be turned off by the second emission control signal supplied to the second emission control line; and an eighth transistor configured to supply an initialization voltage to the third node and to be turned on by the third scan signal supplied to the third scan line.

15. The display device according to claim 14, wherein the second emission control signal is supplied later than the first emission control signal.

16. The display device according to claim 11, wherein a first frequency at which the first scan signal is supplied to the first scan line is equal to the frame frequency, and wherein a second frequency at which the first emission control signal is supplied to the first emission control line is greater than the frame frequency.

17. A method of driving a display device, comprising:

determining a frame frequency based on at least one of a data enable signal and a vertical synchronization signal;

determining, based on grayscales included in image data of a frame, a representative value of a grayscale of the frame;

generating reference voltage data corresponding to a reference voltage based on the frame frequency and the representative value; and supplying, to a pixel, the reference voltage for restraining leakage current in the pixel based on the reference voltage.

18. The method according to claim 17, wherein, for the representative value of the image data being the same, the reference voltage changes as the frame frequency changes from a first frequency to a second frequency.

19. The method according to claim 17, wherein generating the reference voltage data comprises:

comparing the frame frequency and a reference frequency;

outputting a default value of the reference voltage data regardless of the frame frequency and the representative value for the frame frequency being equal to or greater than the reference frequency; and calculating the reference voltage data corresponding to the frame frequency and the representative value with reference to a lookup table for the frame frequency being less than the reference frequency.

* * * * *